US008454204B1

(12) United States Patent
Chang et al.

(10) Patent No.: US 8,454,204 B1
(45) Date of Patent: Jun. 4, 2013

(54) RECESSED LED LIGHTING FIXTURE

(75) Inventors: Seth Chang, Rowland Heights, CA (US); Huan Cao Nguyen, Anaheim, CA (US); James Madden, Philadelphia, PA (US)

(73) Assignee: Cordelia Lighting, Inc., Rancho Dominguez, CA (US)

( * ) Notice: Subject to any disclaimer, the term of this patent is extended or adjusted under 35 U.S.C. 154(b) by 6 days.

(21) Appl. No.: 13/338,191

(22) Filed: Dec. 27, 2011

(51) Int. Cl.
*F21V 29/00* (2006.01)

(52) U.S. Cl.
USPC ..... 362/294; 362/257; 362/92

(58) Field of Classification Search
None
See application file for complete search history.

(56) References Cited

U.S. PATENT DOCUMENTS 7,145,179 B2 12/2006 Petroski
7,399,104 B2 * 7/2008 Rappaport ..... 362/365
7,748,869 B2 * 7/2010 Sevack et al. ..... 362/277
8,128,264 B2 * 3/2012 Genenbacher ..... 362/398
2005/0265016 A1 12/2005 Rappaport
2007/0183154 A1 8/2007 Robson
2007/0211475 A1 9/2007 Sevack et al.
2010/0290240 A1 11/2010 Genenbacher
2011/0267827 A1 * 11/2011 Wein ..... 362/368

FOREIGN PATENT DOCUMENTS

CA 2738802 A1 7/2010

* cited by examiner

*Primary Examiner* — Natalie Walford
(74) *Attorney, Agent, or Firm* — Paul Y. Feng; The Eclipse Group LLP

(57) ABSTRACT

A recessed lighting fixture providing illumination from a light source including a plurality of light emitting diodes (LEDs) wherein the fixture is placed within the ceiling space above a ceiling panel or wall. The fixture has a low aspect ratio heat sink. An interchangeable trim ring has an integrated light reflector and attaches to the bottom of the heat sink via rare earth or super magnets. A flange of the heat sink and a flat annular surface of the trim ring engage each other, providing a large contact surface to enable conductive heat transfer. The flange and flat annular surface are located below the ceiling panel, which is at room temperature to help cool the recessed LED lighting fixture through radiation and air convection.

20 Claims, 6 Drawing Sheets

RECESSED LED LIGHTING FIXTURE

BACKGROUND

The present invention relates generally to lighting fixtures and, more particularly, to a LED recessed lighting fixture that provides improved heat dissipation.

Recessed lighting fixtures are well known in the art. Ideally, such fixtures are designed to be visually unobtrusive in that very little of the lighting fixture is visible from below the ceiling. However, some trim portions are visible as well as the light sources. An opening is cut into the ceiling into which most of the lighting fixture is mounted so that very little extends below the plane of the ceiling. A trim piece or trim ring, which may take the form of a bezel, is generally located at the opening to enhance the appearance of the light fixture and conceal the hole cut into the ceiling. Typically, the trim piece is slightly below the planar surface of the ceiling.

Such bezels or other types of trim pieces also include insulation located between the trim piece and the ceiling. In many cases, recessed lighting fixtures are installed in holes in ceilings where the temperature is much different from that of the room into which the light fixture provides illumination. The insulation tends to oppose changes of the room temperature due to the hole cut in the ceiling for the lighting fixture.

Although described in a ceiling embodiment, such lighting fixtures are also used in walls in both dwelling structures and in automobiles, in numerous commercial building applications, and in many other applications like an RV, custom homes, etc. Such lighting fixtures are generally referred to herein as "recessed."

Different light sources are used for recessed lighting fixtures. Some light sources generate substantial amounts of heat, so much so that the rating of the light fixture must be displayed and warnings given that light sources above a certain wattage could pose an overheating problem and are not to be used. However, in some cases, the lighting fixture must be located a substantial distance away from the object to be illuminated and higher wattage light sources are necessary to develop the amount of illumination needed. Such wattage limits imposed by the lighting fixtures can undesirably limit the amount of light furnished by the fixture. For example, lighting fixtures located in higher ceilings, which are more common today, or lighting fixtures that are meant to shine at an angle other than perpendicular to illuminate an object, may not provide enough light for the object if lower wattage light sources must be used. Consequently, lighting fixtures able to accommodate higher heat levels are desired in such situations. Such lighting fixtures must be able to dissipate increased levels of heat to avoid a hazard.

Typically used in conjunction with a recessed lighting fixture is a "can" or housing, which is fixedly mounted into the ceiling through the ceiling panel opening. Such housings are generally metallic and thermally conductive. They also are generally connected to electrical earth ground. A "trim unit," which may include one or more light sources, a trim ring, and other devices to provide the aesthetic design and lighting functions is mounted within the housing. Various trim units may be available for mounting within any one housing. The trim unit typically receives the light bulb or other light source or sources and provides the necessary electrical power to them for illumination.

SUMMARY OF THE INVENTION

The present invention in a preferred embodiment is directed to a recessed lighting fixture located in an opening in a ceiling panel, the lighting fixture comprising a cylindrical shaped heat sink having a low aspect ratio such that the height is less than the diameter, the heat sink having a top and a bottom, an open center at the top leading to a cavity facing the bottom, the cavity having a sloped wall, the heat sink having a flange at the bottom extending radially outward and defining a flat surface at the bottom. The heat sink includes heat fins disposed at the top and outer circumference. The light source is preferably an array of Light Emitting Diodes (LEDs). An LED driver having an electrical cable extending therefrom is disposed generally on top of the heat fins leaving an air gap between the LED driver and the heat fin in the spaces between the heat fins. An LED array emitting visible light is electrically connected to the LED driver and disposed at the open center, facing downward to emit light out of the recessed fixture.

The lighting fixture includes an interchangeable trim ring having an open center with a sloped wall defining a reflector that is covered in a light reflective material, wherein the reflector overlies the sloped wall of the cavity. The trim ring further includes a flat annular surface engaging the flat surface of the heat sink flange for thermal conduction therebetween to reduce heat generated by the LED driver and LED array.

The trim ring at the flat annular surface and the heat sink flange are located below the ceiling panel or planar surface, such that the structure is exposed to cooler ambient room air, versus above the ceiling panel or planar surface, which area is typically a closed space where ambient heat can build up. The heat sink, fins, flange, and trim ring should be conducive to heat transfer to help dissipate heat of the lighting fixture via conduction, convection, and radiation One or more rare earth magnets are used to attach the flat annular surface of the trim ring to the flat surface of the heat sink flange. As such, portions or all of the trim ring and heat sink flange should be made from magnetically attractive material, or be ferromagnetic.

In various embodiments, the recessed lighting fixture uses an electrical cable that includes a detachable Edison screw plug. Thus, the recessed lighting fixture may be used to retrofit an existing incandescent light fixture that has an Edison screw socket in place.

Further, the open center of the heat sink at the bottom may include a lens enclosing the LED array to help diffuse or diffract the light for a softer lighting effect. In the preferred embodiment, the recessed lighting fixture uses rare earth magnet such as a neodymium magnet. Also, the heat sink is preferably made from cast aluminum to allow better heat transfer through conduction, for example.

These and other aspects, features, and advantages of the present invention will become apparent from the following detailed description of the preferred embodiments which, taken in conjunction with the accompanying drawings, illustrate by way of example the principles of the invention.

DETAILED DESCRIPTION OF THE PREFERRED EMBODIMENTS

The present invention in various preferred embodiments is directed to a recessed lighting fixture that uses a LED as the light source to conserve energy and for long life of the light source as compared to, for example, incandescent bulbs. The present invention light fixture can be installed in a residential new construction or used to retrofit a pre-existing home or building that has recessed lighting fixtures.

Figure 1:
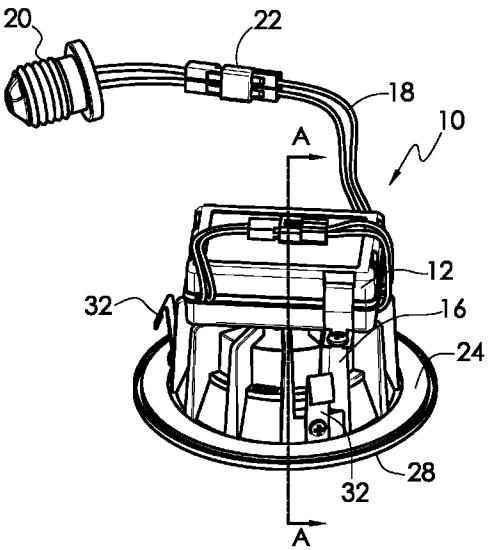
FIG. 1 is a top perspective view of a preferred embodiment of the present invention recessed LED lighting fixture.

FIG. 1 is a perspective view of a preferred embodiment recessed lighting fixture 10. The lighting fixture is has a LED light source that is powered by an LED driver 12, which is the power supply and voltage control for the LED light source. In normal operation, the LED light source and the LED driver 12 generate a lot of heat, so a heat sink16 is used to conduct and dissipate heat from both. An electrical connection or power cables 18 supplies electrical power to the LED driver 12. The power cables 18 terminate in an Edison type screw plug 20. This Edison screw plug 20 allows the lighting fixture 10 to replace an incandescent bulb inside a preexisting lighting fixture. In such a retrofit, the preexisting incandescent bulb is removed and the Edison screw plug 20 is screwed into the Edison bulb socket. The power cables 18 also include a snap lock connector 22 for the end user or electrician to disconnect the Edison screw plug 20 from the lighting fixture 10. This is for new construction where no Edison screw-type socket is needed, so the Edison plug 20 can be detached. Once detached, the snap lock connector 22 or its power cables 18 can be directly connected to the standard household wiring.

Figure 2:
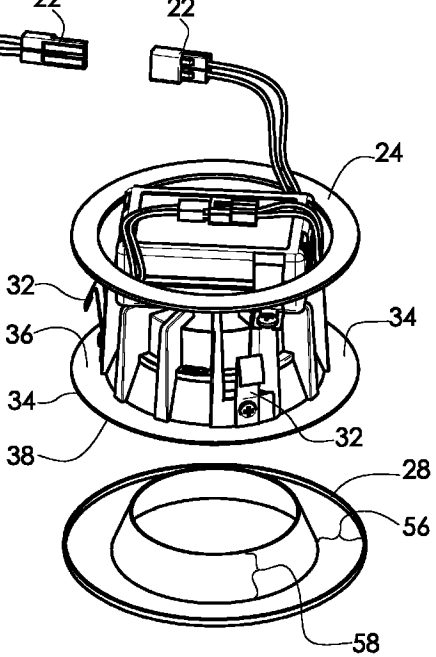
FIG. 2 is a top perspective view of the lighting fixture from FIG. 1 with the interchangeable trim ring detached and gasket loose around the fixture.

FIGS. 1 and 2 show that the lighting fixture 10 includes an optional annular-shaped gasket 24 to seal the environment below the ceiling panel from above the ceiling panel. An end user interchangeable trim ring 28 is shown attached to the bottom of the lighting fixture 10 in FIG. 1 and detached in FIG. 2. The trim ring 28 faces downward where the trim ring 28 is visible to the end use, presumably the homeowner, so the interchangeability feature enables the homeowner to select the style to match the color and decor of the room. The interchangeable trim ring 28 can be made in different finishes, designs, shapes, sizes, etc. Its surface finish can be painted, anodized, and/or electroplated to offer a variety of finishes. Accordingly, the homeowner can select from the store the trim rings 28 that best match his or her home's decor and color scheme. To enable this interchangeability, the trim rings 28 are preferably attached to the lighting fixture 10 via magnets (described in detail below), so attaching or detaching the trim ring 28 is easily accomplished by the homeowner without need for any tools or manipulation of complicated hardware.

Figure 3:
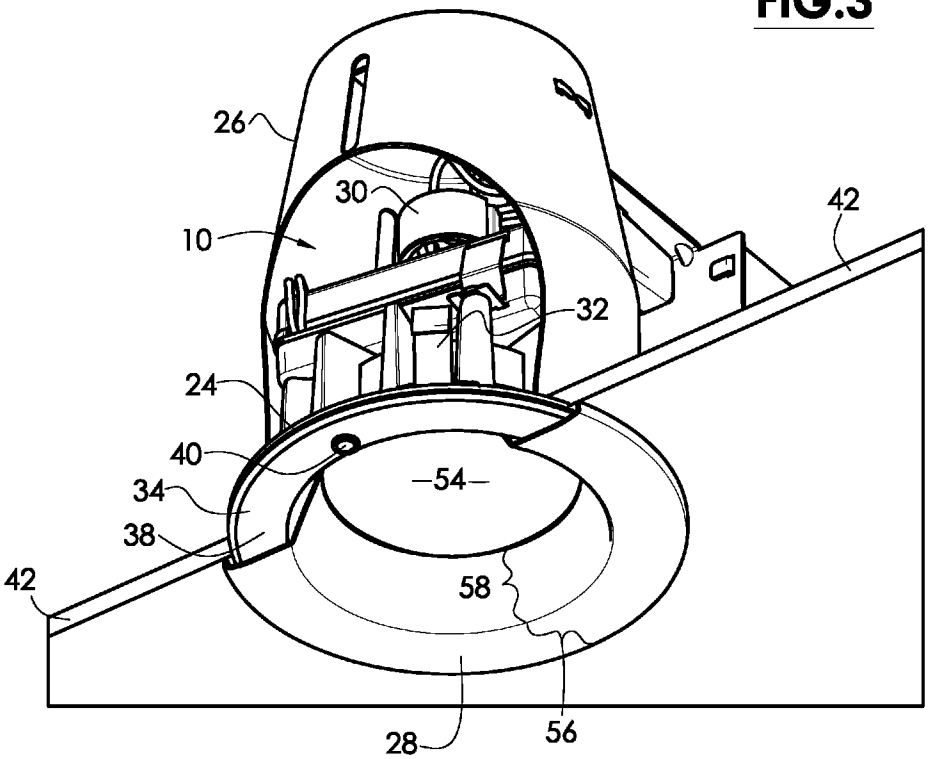
FIG. 3 is a bottom-looking-up perspective view of the preferred embodiment lighting fixture from FIG. 1 in use, wherein the fixture is installed inside a can and positioned in an opening of a ceiling panel.

FIG. 3 depicts the present invention lighting fixture 10 from underneath-looking-up, as used in a retrofit application. The lighting fixture 10 is installed inside a housing or "can" 26 already in place in the home that is being retrofitted. The can 26 is a standard piece of hardware in residential home and commercial building construction that contains the recessed lighting fixture, which historically uses an incandescent bulb. The can is typically cylindrical in shape with a closed end and an open end, wherein the lighting fixture is mounted to the interior while electrical cables and fixture hardware are attached to the exterior.

FIG. 3 shows the fixture 10 connected to the Edison socket 30 already present inside the can 26 to power the new fixture 10. Spring clips 32 extending outward from the heat sink 16 snap into complementary receiving slots or ledges inside the can 26 to hold the fixture 10 to the can 26.

The short, cylindrical heat sink 16 preferably includes a radial, annular flange 34 around the circumference at its bottom. The heat sink flange 34 has a flat, top annular surface 36 (FIG. 2) and a flat, bottom annular surface 38 (FIG. 3). The gasket 24 rests on the top annular surface 36. The bottom annular surface 38 fits flush against a flat annular top surface of the trim ring 28. Magnets 40 are embedded into the bottom annular surface 38.

FIG. 3 further shows the LED lighting fixture 10 installed to a permanent ceiling drywall, ceiling tile or panel, or like planar surface 42, found in typical residential homes or commercial construction. The ceiling panel or planar surface 42 separates the living space of the room below it from the attic or air space above it where electrical cables, insulation, and HVAC ducting are contained.

Figure 4:
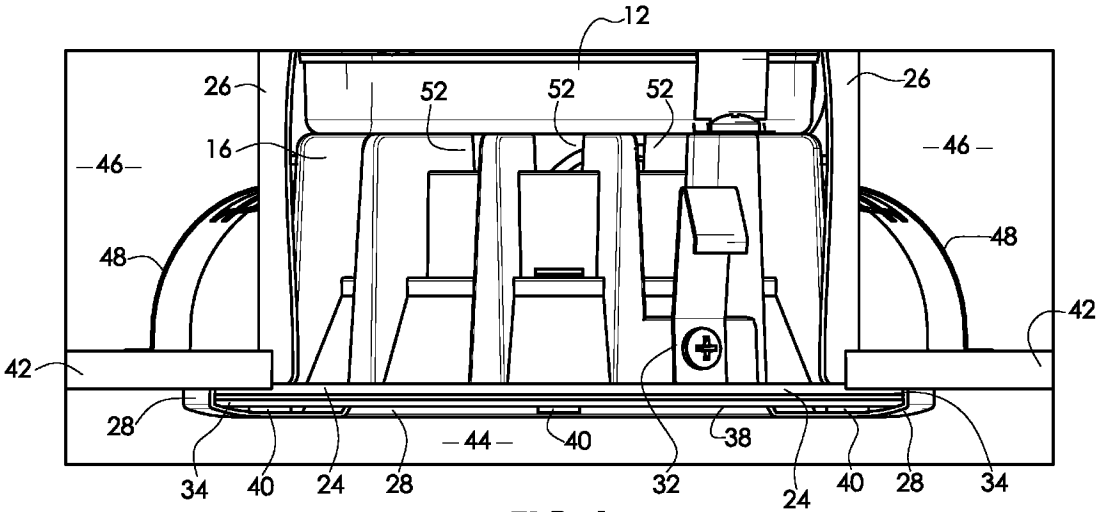
FIG. 4 is an enlarged, detail view of the preferred embodiment heat sink and surrounding structures.

In the preferred embodiment, the heat sink flange 34 is strategically located beneath the ceiling panel or planar surface 42. This is best seen in FIG. 3. FIG. 4 is a side elevational view of the structures in FIG. 3, partially in cross-section. FIG. 4 shows the can 26 and the light fixture 10 generally situated in the traditional arrangement above the ceiling panel or planar surface 42, while the heat sink flange 34 protrudes below the planar surface 42. Feet 48 on the outside of the can 26 help stabilize it on top of the ceiling panel or planar surface 42.

In FIG. 4, the heat sink flange 34 is situated completely below the level of the ceiling panel or planar surface 42. The gasket 24 rests atop the flange 34 on its top annular surface 36 (FIG. 2) and abuts the underside of the ceiling panel or planar surface 42 (FIG. 4). The gasket 24 creates a generally air-tight seal between the top annular surface 36 of the flange 34 and the ceiling panel 42. The interchangeable trim ring 28 engages the bottom annular surface 38 of the heat sink flange 34. A plurality of magnets 40 attaches the trim ring 28 to the flange 34.

FIG. 4 thus shows the division by the ceiling panel or planar surface 42 of the ceiling space into the living area 44 below and the air space or attic 46 above. Ambient temperatures generated inside the can 26 is generally 70 degrees C. or higher. Depending on season, climate, geographic region, thermostat setting in the room, ambient temperature in the air space or attic 46 above the ceiling panel 42 can reach over 100 degrees C. Typical room temperature in the living area 44 below the ceiling panel 42 is about 25 degrees C. or lower. Therefore, by locating the heat sink flange 34, which is a large body of material of the heat sink 16, below the ceiling panel or planar surface 42, the heat generated from the LED light source and LED driver can be dissipated by conduction through the heat sink 16, then via radiation and air convection at the flange 34. Because the ambient temperature in the living area 44 beneath the ceiling panel or planar surface 42 is on average about 45 degrees C. below that of the attic or air space 46 above the ceiling panel 42, heat transfer and heat dissipation are greatly facilitated by this arrangement.

The trim ring 28 is in direct contact with the heat sink flange 34 over a large surface area that is the bottom annular surface 38. Through thermal conduction at these contact surfaces, the trim ring 28 also acts as a heat sink and further helps dissipates LED and LED driver generated heat through radiation and air convection to the ambient living area environment 44, which is at 25 degrees C. or lower. Because of its relatively large surface area being exposed to the cooler environment beneath the ceiling panel 42, the trim ring 28 functions effectively to dissipate heat. Through empirical observations, the above-described cooling mechanism lowers LED case temperature. As a result, the LED light source when properly cooled emits a higher luminance for a given wattage and enjoys a prolonged duty life.

Figure 7:
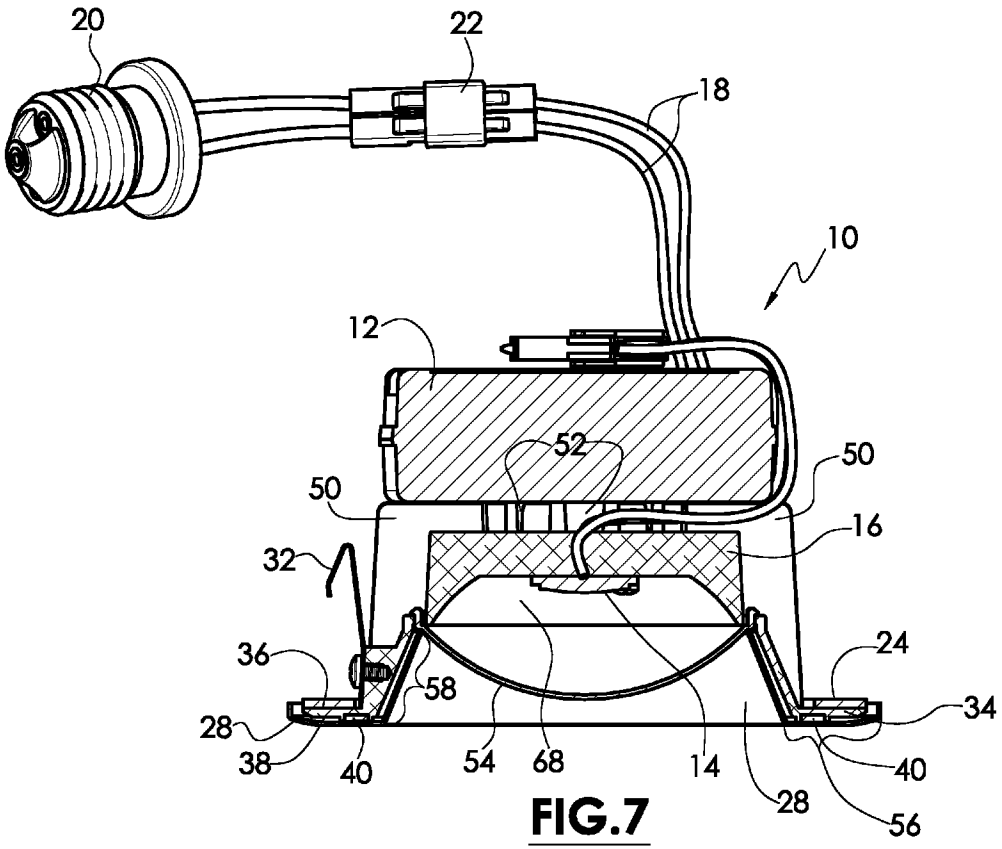
FIG. 7 is a cross-sectional view of the lighting fixture taken at about line A-A of FIG. 1.
Figure 8:
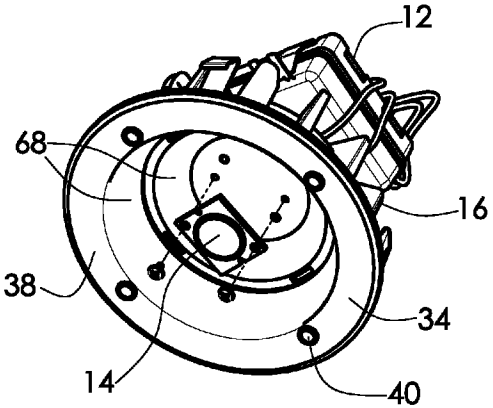
FIG. 8 is a bottom perspective view of the lighting fixture with the lens cover removed and the LED array disassembled.

FIG. 7 is a cross-sectional view of the lighting fixture 10 taken along line A-A of FIG. 1. FIGS. 7 and 8 show the preferred embodiment lighting fixture 10 having the LED driver 12 mounted atop the heat sink 16. The heat sink 16 has a cylindrical shape with a hollow center or cavity 68 and an open bottom, and the inner wall of this cavity 68 is sloped. The LED light source, here an LED array 14, is mounted on the bottom side of the heat sink 16 within the cavity 68. The heat sink 16 preferably has a very low aspect ratio such that its diameter is greater than its height, making it very low profile. This low profile LED lighting fixture 10 allows it to be installed in a variety of preexisting can sizes, including cans that have a shallow depth.

Figure 9:
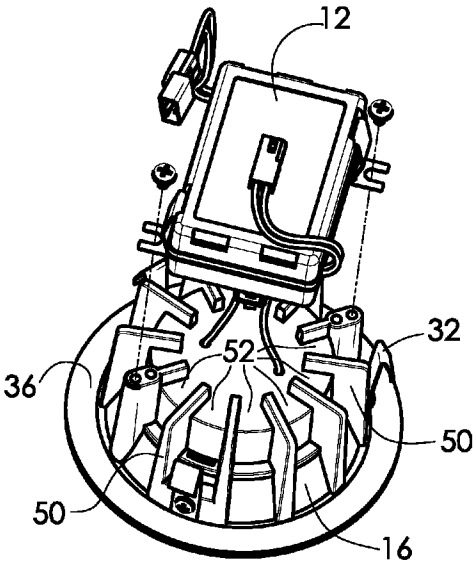
FIG. 9 is a top-looking-down perspective view of the lighting fixture of FIG. 1 wherein the LED driver is disassembled from the heat sink, and the Edison plug has been detached from the electrical connection.

FIG. 9 shows the heat sink 16 having a plurality of heat dissipation fins 50 extending radially along the outer circumferential wall of the heat sink 16 and on top of the heat sink 16. The LED driver 12 preferably mounts on top of the heat sink fins 50, thereby leaving air gaps 52 between the fins 50 and between the LED driver 12 and the top of the heat sink 16. The air gaps 52 are in fluid communication with each other, and can be seen in FIGS. 4, 7, and 9. Via empirical observations, the air gaps 52 provide air movement therethough and expose more surface area of the LED driver 12 to the ambient air, which enhances air convection cooling.

As best seen in the cross-sectional view of FIG. 7, the heat sink 16, fins 50, and flange 34 are all preferably formed from one unitary piece of material for the most efficient thermal conduction of heat from the LED array 14 and the LED driver 12 to the fins 50 and flange 34. Cast aluminum is preferably used for the heat sink, fins, and flange. Steel and iron alloys may be used as well.

FIGS. 7 and 8 show the LED array 14 and LED driver 12. As is recognized in the art, they generate heat. To help dissipate this heat, they are directly attached to the heat sink 16. The LED array 14 faces and emits visible light through the cavity 68 in the heat sink 16 downward into the living space 44 below. An optional lens cover 54 softens and/or diffuses the light emitted by the LED array 14 and fits inside the cavity 68.

The interchangeable trim ring 28 has a relatively large mass and surface area, as seen in FIGS. 2, 3, and 7, to enhance heat dissipation. This large mass and large surface area of the trim ring 28, in the preferred embodiment, are composed of an outer ring component 56 and an inner frusto-conical cone component 58.

As best seen in FIG. 7, the top surface of the outer ring component 56 engages the bottom annular surface 38 of the heat sink flange 34, which is conducive to heat transfer. The inner frusto-conical cone component 58 is a sloped wall that leads up to the lens cover 54. The cone component 58 abuts and overlies a portion of the interior sloped wall of the cavity 68 inside the heat sink 16. This contact area further enhances conduction of heat from the heat sink 16 to the trim ring 28, where the cone component 58 then dissipates the heat.

In FIG. 7, the interior of the cone component/sloped wall 58 directly surrounding the lens 54 may be layered or coated with light reflective material, so that the sloped wall 58 acts as a reflector for the lighting fixture 10. Thus, the preferred embodiment trim ring 28 functions as (a) an aesthetic finish for the lighting fixture 10, (b) a light reflector, and (c) a heat sink. The trim ring 28, to be attracted by the magnet 40, preferably includes a ferromagnetic material. It is preferably made from stamped steel, allowing it to be attracted by the magnets and also functioning well as a heat conductor. Its surfaces can be treated, coated, painted, etc. for the customer desired aesthetics and to function as a light reflector. The trim ring in alternative embodiments may be a composite with a steel or iron skeleton and a plastic molded shell or facade. Or the entire trim ring may be plastic, fiberglass, etc., and patches of ferromagnetic material are embedded into the trim ring.

The permanent magnets 40 used to join trim ring 28 and heat sink flange 34 are preferably a type of samarium-cobalt magnet, a neodymium magnet, a ceramic/ferrite magnet, or an alnico magnet. The preferred embodiment uses the neodymium magnet or samarium-cobalt magnet, generally known as "rare earth" magnets. Most preferably, the neodymium magnet (an NdFeB alloy), also known as a "super magnet," is chosen because of its high remanence (magnetic field strength) and high coercivity (resistance to being demagnetized). These characteristics are preferred because the magnets 40 are used in a harsh environment by being attached to a part of a heat sink, specifically, the heat sink flange 34. From the LED lighting fixture being turned on and off in normal use, there is cyclic heating and cooling of the heat sink flange 34 and correspondingly the magnet 40. Hence, through empirical observation, the neodymium magnet is preferred for use with the present invention LED lighting fixture.

Further, the strong magnetic field of the neodymium magnet provides the end user with a positive engagement and perceived mechanical lock when the trim ring is installed. The attachment of the trim ring will not loosen or self detach over time.

Figure 6:
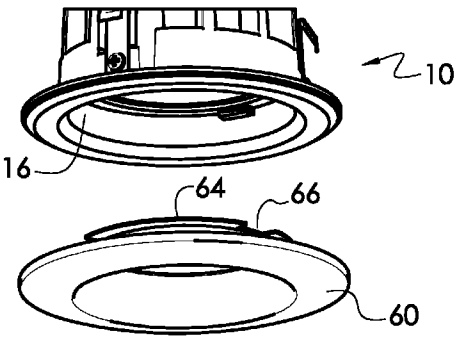
FIG. 6 is an isolated view of the bottom portion of an alternative lighting fixture with a twist lock interchangeable trim ring.
Figure 5:
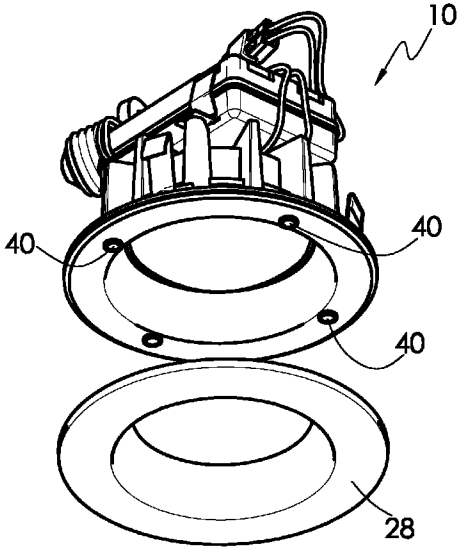
FIG. 5 is a bottom perspective view of the lighting fixture from FIG. 1 with the interchangeable trim ring detached.

FIG. 5 shows the preferred embodiment where the trim ring 28 is attached to the LED lighting fixture 10 by use of magnets 40. FIG. 6 is an alternative embodiment where the trim ring 60 is attached mechanically to the LED lighting fixture 10. This embodiment employs a twist lock. Here, the interior of the heat sink 16 includes a ledge 62 and the trim ring 60 has a lip 64 with a cutout 66 that receives the ledge 62. The trim ring 60 is pushed against the fixture so that the ledge passes through the cutout 66, then twisted so the ledge 62 is no longer aligned with the cutout 66. The ledge 62 is thus captured by the lip 64 so the trim ring 60 cannot detach from the fixture. The lip 64 may optionally have a slight incline as in a screw thread to help advance the trim ring 60 into the lighting fixture 10 for a tighter fit.

Although the present invention has been described in terms of certain preferred embodiments, other embodiments that are apparent to those of ordinary skill in the art are also within the scope of the invention. Components and features of one embodiment may be combined with other embodiments. Accordingly, the scope of the invention is intended to be defined only by reference to the appended claims. While variations have been described and shown, it is to be understood that these variations are merely exemplary of the present invention and are by no means meant to be limiting.

We claim:

1. A recessed lighting fixture located in an opening of a surface, the surface having an outer side and an inner side, the recessed lighting fixture comprising:

an LED driver having a power cable;

an LED array disposed underneath the LED driver and connected thereto;

a heat sink having a cylindrical body with a top and an open bottom, the top receiving the LED driver and LED array disposed at the open bottom, wherein a plurality of heat fins extend radially from the heat sink, and wherein a radial flange circumscribes the bottom of the heat sink and defines a flat, first annular surface, wherein the heat sink, fins, and flange include a heat dissipating and conductive material;

at least one magnet disposed on the first annular surface of the flange;

an interchangeable trim ring with an open center, a top and a bottom, the trim ring including a heat dissipating and conductive material and a magnetically attractive material, and further including a flat, second annular surface at the top that abuts the first annular surface of the flange for thermal conduction therebetween, the first and second surfaces joined via at least the magnet; and wherein the flange of the heat sink and the trim ring are located at the outer side of the surface.

2. The recessed lighting fixture of claim 1, wherein the fixture includes a plurality of magnets recessed into the flange of the heat sink.

3. The recessed lighting fixture of claim 1, wherein heat sink, fins, and flange are formed from an single, integral piece of heat dissipating and conductive material.

4. The recessed lighting fixture of claim 3, wherein the flat, second annular surface of the trim ring toward the open center transitions into a frusto-conical wall.

5. The recessed lighting fixture of claim 4, wherein the frusto-conical wall at the bottom of the trim ring is coated with a light reflective material.

6. The recessed lighting fixture of claim 1, wherein the bottom of the trim ring is at least one of electro-plated, anodized, and painted.

7. The recessed lighting fixture of claim 1, wherein the magnet is selected from the group consisting of a samarium-cobalt magnet, a neodymium magnet, a ceramic/ferrite magnet, or an alnico magnet.

8. The recessed lighting fixture of claim 1, wherein the heat sink includes a material selected from the group consisting of aluminum, steel, cast iron, or ceramic.

9. The recessed lighting fixture of claim 1, wherein the trim ring includes a sloped wall surrounding the open center and the sloped wall includes a light reflective surface.

10. A recessed lighting fixture located in an opening of a surface, the surface having an outer side and an inner side, the recessed lighting fixture comprising:

an LED driver having a power cable;

an LED array disposed underneath the LED driver and connected thereto;

a heat sink having a cylindrical body with a top and an open bottom, wherein a plurality of heat fins extend radially from and above the heat sink such that the LED driver rests on top of the heat fins leaving a plurality of open spaces therebetween, and wherein a radial flange circumscribes the bottom of the heat sink and defines a flat, first annular surface;

wherein the heat sink, fins, and flange include a heat dissipating and conductive material;

at least one magnet disposed on the first annular surface of the flange;

an interchangeable trim ring with an open center, a top and a bottom, including a heat dissipating and conductive material and a magnetically attractive material, and further includes a flat, second annular surface at the top that abuts against the first annular surface of the flange for thermal conduction, and attaching thereto via at least the magnet, the trim ring further including a sloped wall surrounding the open center having a light reflective surface; and wherein the heat sink flange and the trim ring are located at the outer side of the surface.

11. The recessed lighting fixture of claim 10, wherein the interchangeable trim ring at the bottom includes a decorative surface treatment.

12. The recessed lighting fixture of claim 10, wherein the magnet includes a rare earth magnet.

13. The recessed lighting fixture of claim 10, wherein an air tight gasket is disposed on top of the flange of the heat sink.

14. The recessed lighting fixture of claim 10, wherein the power cable includes a detachable Edison screw plug.

15. The recessed lighting fixture of claim 14, wherein the power cable includes a snap lock connector to connect and disconnect the Edison screw plug.

16. A recessed lighting fixture located in an opening in a ceiling panel, the lighting fixture comprising:

a cylindrical shaped heat sink having a low aspect ratio such that the height is less than the diameter, the heat sink having a top and a bottom, an open center at the top leading to a cavity facing the bottom, the cavity having a sloped wall, the heat sink having a flange at the bottom extending radially outward and defining a flat surface at the bottom;

heat fins disposed at the top and outer circumference of the heat sink;

an LED driver having an electrical cable, wherein the LED driver is disposed on the heat fins leaving an air gap between the LED driver and the heat fin;

an LED array electrically connected to the LED driver and disposed at the open center;

an interchangeable trim ring having an open center with a sloped wall defining a reflector that is covered in a light reflective material, wherein the reflector overlies the sloped wall of the cavity, the trim ring further including a flat annular surface engaging the flat surface of the heat sink flange for thermal conduction therebetween, wherein the trim ring at the flat annular surface and the heat sink flange are disposed below the ceiling panel; and a rare earth magnet attaching the flat annular surface of the trim ring to the flat surface of the heat sink flange.

17. The recessed lighting fixture of claim 16, wherein the electrical cable includes a detachable Edison screw plug.

18. The recessed lighting fixture of claim 16, wherein the open center include a lens enclosing the LED array.

19. The recessed lighting fixture of claim 16, wherein the rare earth magnet includes a neodymium magnet.

20. The recessed lighting fixture of claim 16, wherein the heat sink includes cast aluminum.

* * * * *